US008261911B2

(12) United States Patent
Lee

(10) Patent No.: US 8,261,911 B2
(45) Date of Patent: Sep. 11, 2012

(54) PORTABLE WRENCH HOLDER

(76) Inventor: Hong-Jen Lee, Taichung (TW)

( * ) Notice: Subject to any disclaimer, the term of this patent is extended or adjusted under 35 U.S.C. 154(b) by 21 days.

(21) Appl. No.: 12/960,579

(22) Filed: Dec. 6, 2010

(65) Prior Publication Data

US 2012/0138497 A1 Jun. 7, 2012

(51) Int. Cl.
*B65D 85/28* (2006.01)
*A47F 7/00* (2006.01)

(52) U.S. Cl. ..... 206/376; 206/372; 211/70.6

(58) Field of Classification Search ..... 206/349, 206/372–378, 488, 45.24, 806, 45.23; 211/70.6, 211/60.1
See application file for complete search history.

(56) References Cited

U.S. PATENT DOCUMENTS

| | | | | |
|---|---|---|---|---|
| 3,370,696 | A * | 2/1968 | Groe | 294/161 |
| 5,346,063 | A * | 9/1994 | Chow | 206/376 |
| 5,941,386 | A * | 8/1999 | Hu et al. | 206/376 |
| 5,967,340 | A * | 10/1999 | Kao | 211/70.6 |
| 6,360,892 | B1 * | 3/2002 | Chen | 206/376 |
| 6,401,923 | B1 * | 6/2002 | Huang | 206/376 |
| 6,758,350 | B2 * | 7/2004 | Lin | 211/70.6 |
| 6,832,684 | B2 * | 12/2004 | Huang | 206/376 |
| 6,896,136 | B2 * | 5/2005 | Hu | 206/378 |
| 7,537,124 | B2 * | 5/2009 | Chen | 211/70.6 |
| 7,559,427 | B2 * | 7/2009 | Hu | 206/764 |
| 7,584,845 | B2 * | 9/2009 | Cheng | 206/376 |
| 7,987,975 | B1 * | 8/2011 | Lee | 206/45.23 |
| 7,987,981 | B1 * | 8/2011 | Lee | 206/376 |
| 8,047,386 | B2 * | 11/2011 | Chen | 211/70.6 |
| 2002/0070185 | A1 * | 6/2002 | Chen | 211/70.6 |
| 2003/0141266 | A1 * | 7/2003 | Lin | 211/70.6 |
| 2004/0000497 | A1 * | 1/2004 | Huang | 206/376 |
| 2004/0094444 | A1 * | 5/2004 | Chen | 206/376 |
| 2006/0096878 | A1 * | 5/2006 | Chen | 206/376 |
| 2009/0218302 | A1 * | 9/2009 | Winnard | 211/70.6 |
| 2010/0252512 | A1 * | 10/2010 | Cheng | 211/70.6 |

* cited by examiner

*Primary Examiner* — Steven A. Reynolds

(57) ABSTRACT

The present invention discloses a wrench holder comprising a main frame, a hand grip, a slidable fastener, two knobs and a cover plate. There is a plurality of recesses defined on the main frame for wrenches to be held. The hand grip is rotatably allocated at the bottom of the main frame, and the slidable fastener is movably applied at the bottom of the main frame as well to limit the hand grip revolving against the main frame. The cover plate provides the wrenches held within the main frame to be sheltered. The wrench holder of the present invention is designed to improve protection for wrenches and convenience for users.

6 Claims, 7 Drawing Sheets

PORTABLE WRENCH HOLDER

FIELD OF THE INVENTION

The present invention relates to a portable wrench holder, particularly to a wrench holder which allows a plurality of wrenches to be steadily held and enhances its flexibility for users.

BACKGROUND OF THE INVENTION

According to the prior art of a wrench holder disclosed in U.S. Pat. No. 5,346,063, it comprises a flat main frame which has two pieces of plates protruded from its both sides on the front. There is a plurality of recesses symmetrically defined on the two plates for wrenches to be placed. Each opening of the recess has a hook, and the wrenches are prevented falling from the recesses by the hooks. There are certain disadvantages from the prior art:

1. Wrenches are not able to be firmly held in the recesses with only two plates and simple-designed recesses on the main frame.

2. The holder can only be laid down due to the flat design of the main frame. Because the wrench holder is not standable, it causes inconvenient for users to choose proper wrenches.

SUMMARY OF THE INVENTION

The object of the present invention is to provide a wrench holder with improved protection for wrenches and convenience for users. In order to achieve the foregoing object, the wrench holder comprises a main frame, a hand grip, a slidable fastener, two knobs and a cover plate. There is a plurality of recesses defined on the main frame for wrenches to be held. The hand grip is allocated at the bottom of the main frame, and the slidable fastener is movably applied at the bottom of the main frame as well to limit the hand grip revolving against the main frame. The cover plate provides the wrenches held within the main frame to be sheltered.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
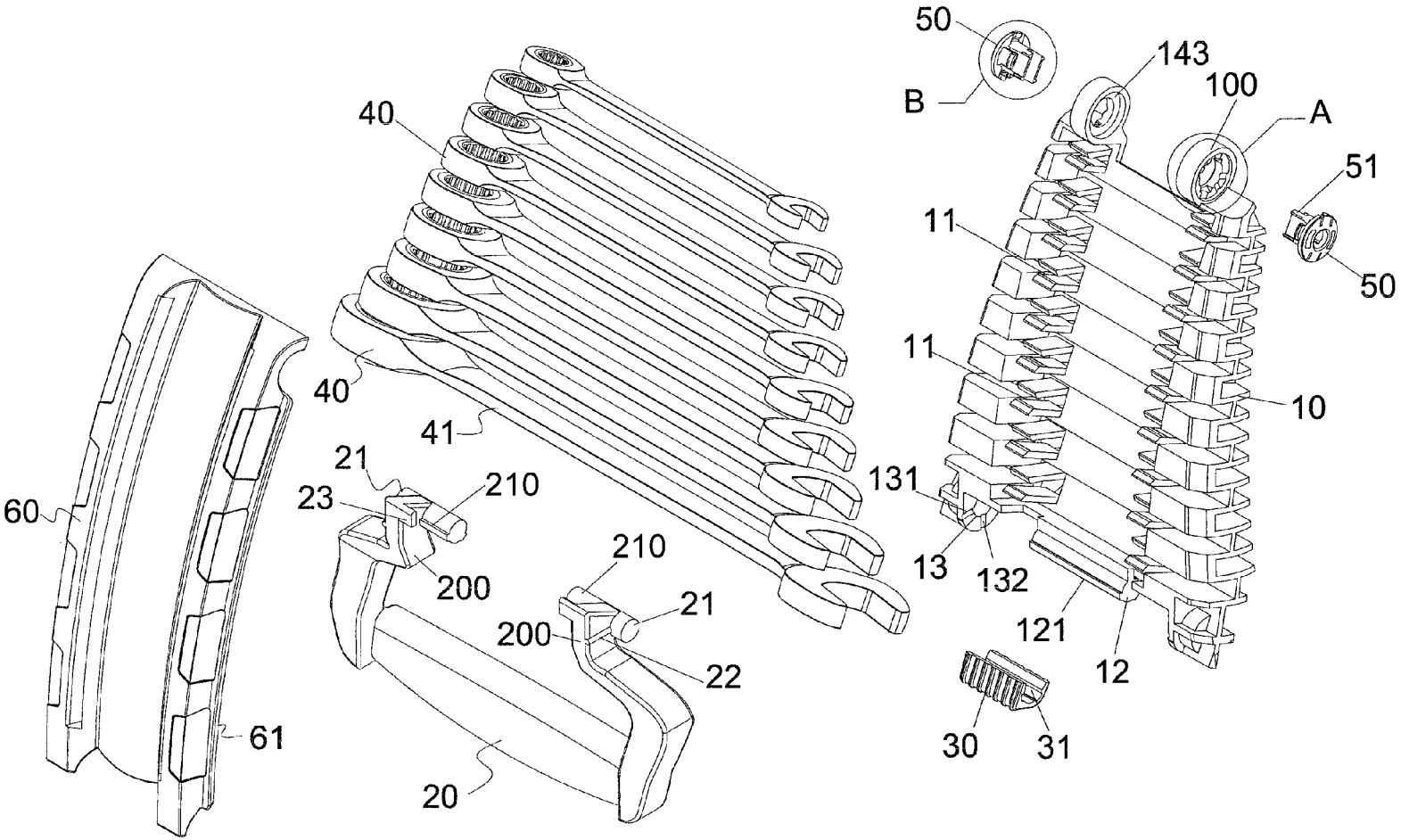
FIG. 1 is an exploded perspective view of the present invention.
Figure 2:
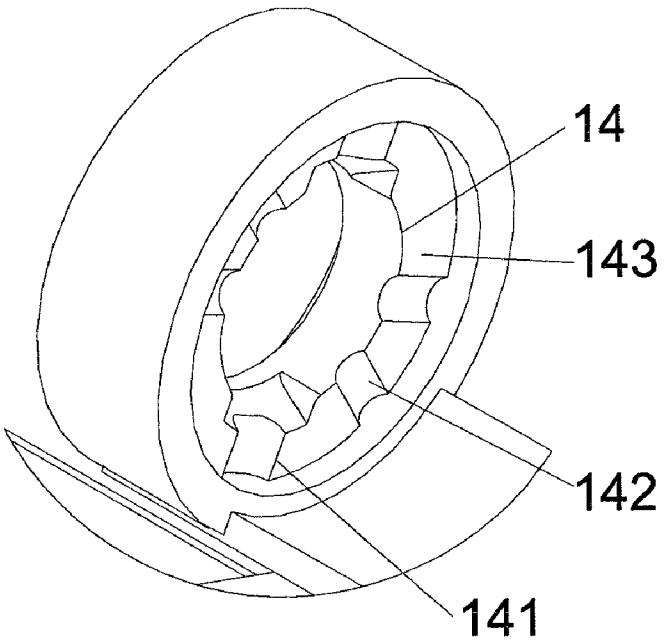
FIG. 2 is an enlarged view taken from circle A in FIG. 1.
Figure 3:
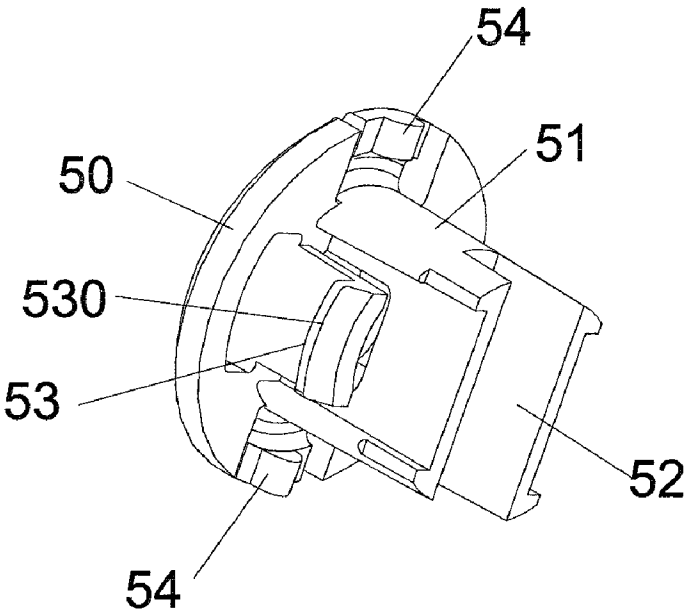
FIG. 3 is an enlarged view taken from circle B in FIG. 1.
Figure 5:
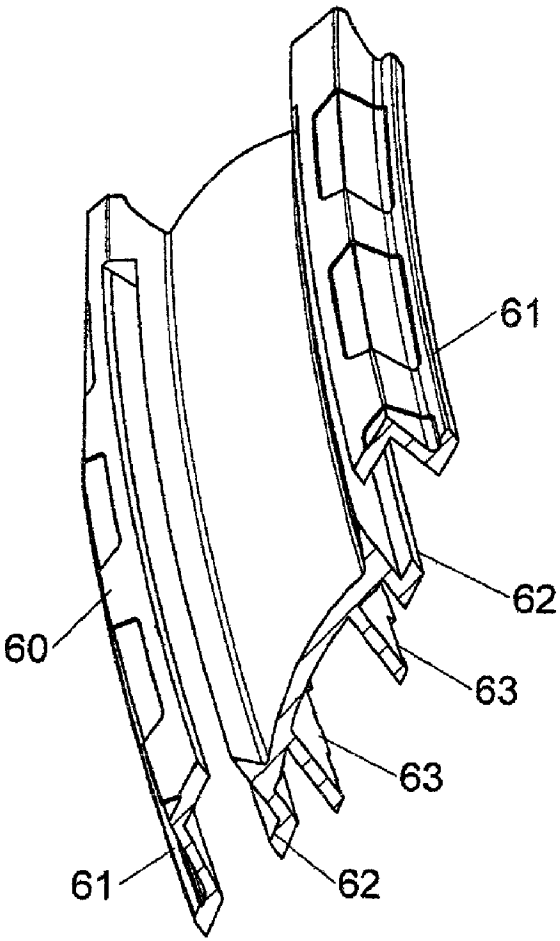
FIG. 5 is a cross-sectional view taken along plane C-C in FIG. 4.
Figure 4:
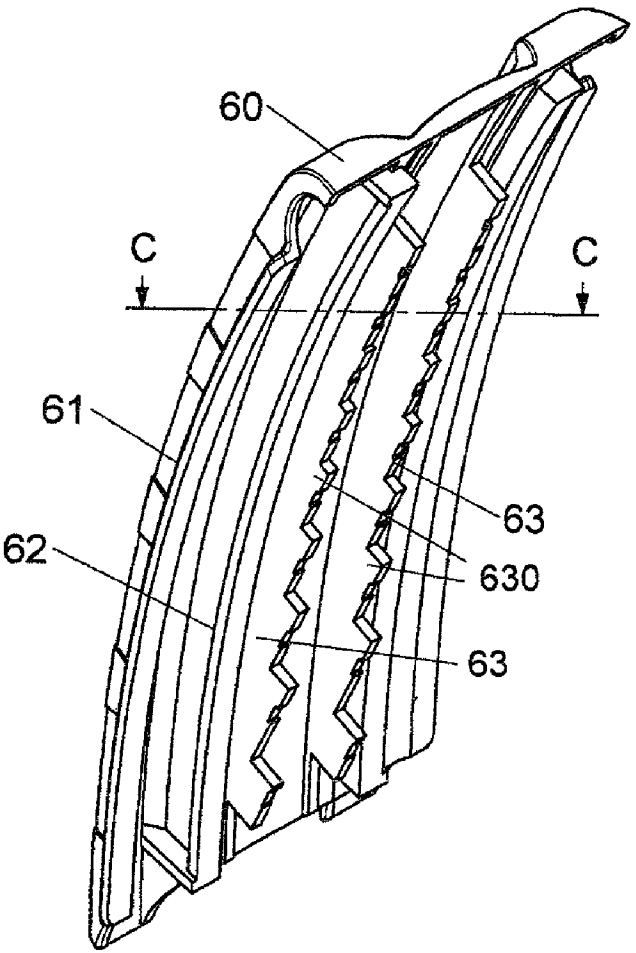
FIG. 4 is a perspective rear view of the cover plate in accordance with the present invention.

Referring to FIGS. 1 to 6, the portable wrench holder of the present invention comprises a main frame 10, a hand grip 20, a slidable fastener 30, two knobs 50 and a cover plate 60. The mechanism of the wrench holder is detailed as below:

the main frame 10 having a curved body extended upwards, a plurality of recesses 11 with lateral openings arranged along its front, and a strip rail 12 allocated at the middle portion of the bottom main frame 10 with protruded strips 121 on its two sides in order to form a non-circular cross section for the strip rail 12; each pair of recesses 11 allowing the handle of a wrench to be engaged and positioned; two axle holes 13 being symmetrically defined at the bottom of the main frame 10, each end of the strip rail 12 being coaxially correspondent with the axle holes 13, and two grooves 131/132 being radially developed at the port of each axle hole 13 with an included angle between them; two pivot rings 100 being separately defined on the top of the main frame 10, each pivot ring 100 having a pivot hole 14 with two furrows 141/142 radially extended at its outer port, the furrows 141/142 having an included angle between them, and an annular prop edge 143 being extended at the inner port of each pivot hole 14;

the hand grip 20 shown in the drawing being bow-shaped with two necks 200 jointed at its both ends, each neck 200 having a shaft 21 extended outwards and a coaxial protruded rod 210 extended inwards, a protruded portion 22 being radially extended from one side of the shaft 21 and a stop piece 23 being arranged at the inner side of the neck 200 close to the protruded rod 210, and the shape of the protruded rod 210 being the same as the cross section of the strip rail 12; the hand grip 20 and the main frame 10 being integrated as the shaft 21 being inserted into the axle hole 13, the two protruded rods 210 extended at the ends of the hand grip 20 being respectively aligned with the two distal ends of the strip rail 12, and the protruded portion 22 being lodged in the groove 131 or the groove 132 to position the hand grip 20 as the hand grip 20 being revolved against the main frame 10 at a certain angle;

the slidable fastener 30 having a sunken housing 31 laterally penetrated at one side, the cross sections of the housing 31 and the strip rail 12 being matched for the housing 31 to hold on to the strip rail 12 and to make the slidable fastener 30 movable along the strip rail 12; and the hand grip 20 being fixed against the main frame 10 as the slidable fastener 30 being moved to one end of the strip rail 12 with its housing 31 holding on to the shaft 21;

the knobs 50 having a pivot shaft 51 protruded on one side of each knob 50 with two locking tenons 53 and two locking wedges 54, a lateral locking trough 52 being defined through the end of the pivot shaft 51 and the two locking wedges 54 being allocated on the knobs 50 corresponding to two lateral ends of the locking trough 52 respectively, the locking tenons 53 being symmetrically arranged along the central axis of the knob 50 and a hook 530 being defined at the end of the locking tenon 53 on one side; the knob 50 being lodged in one port of the pivot hole 14 and the hook 530 of the locking tenon 53 being clasped on the prop edge 143 as the pivot shaft 51 being turned and inserted into the pivot hole 14, and two locking wedges 54 being lodged in the furrow 141 or the furrow 142 for positioning purpose as the knob 50 being turned against the pivot hole 14; and the cover plate 60 allowing the front side of the main frame 10 to be covered, a pair of first holding strips 61, a pair of second holding strips 62 and a pair of protruded plates 63 being extended in parallel on the inner side of the cover plate 60, the first holding strips 61 and the second holding strips 62 having L-shaped cross sections, each protruded plate 63 having a plurality of ratchets 630 vertically arranged on its top end for positioning the handles of wrenches 40; two ends of each first holding strips 61 engaging with the stop pieces 23 at the two ends of the hand grip 20 respectively and two ends of each second holding strips 62 movably engaging with the locking troughs 52 of the knobs 50 respectively for the cover plate 60 being able to vertically move against the main frame 10 in order to open or close the cover plate 60.

Figure 6:
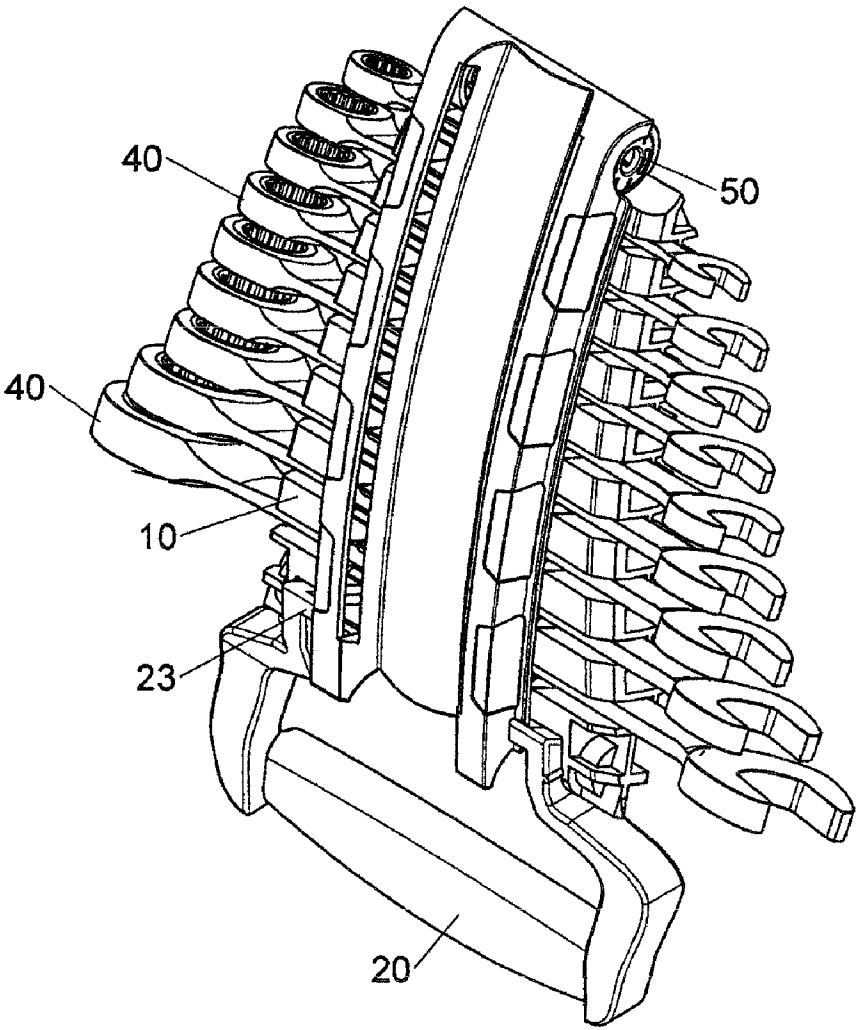
FIG. 6 is an assembled perspective view of the present invention.
Figure 8:
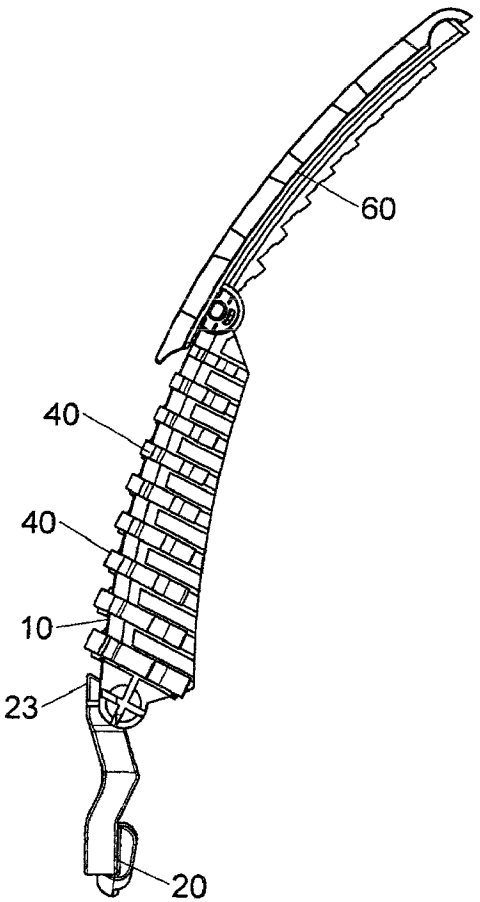
FIG. 8 is a side view of the cover plate pulled up in accordance with the present invention.
Figure 7:
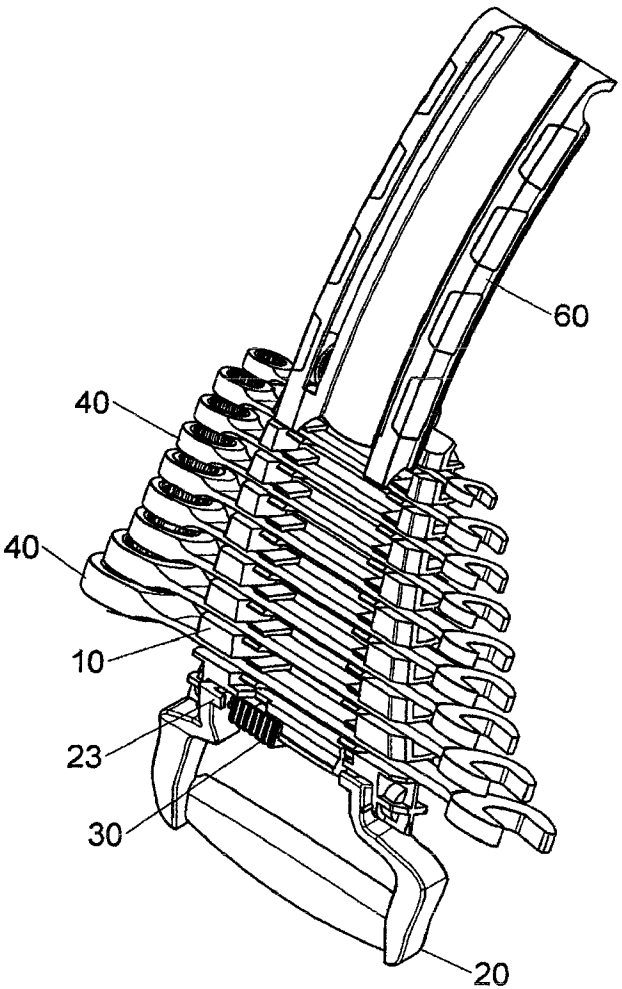
FIG. 7 is a perspective diagram of the cover plate pulled up in accordance with the present invention.
Figure 10:
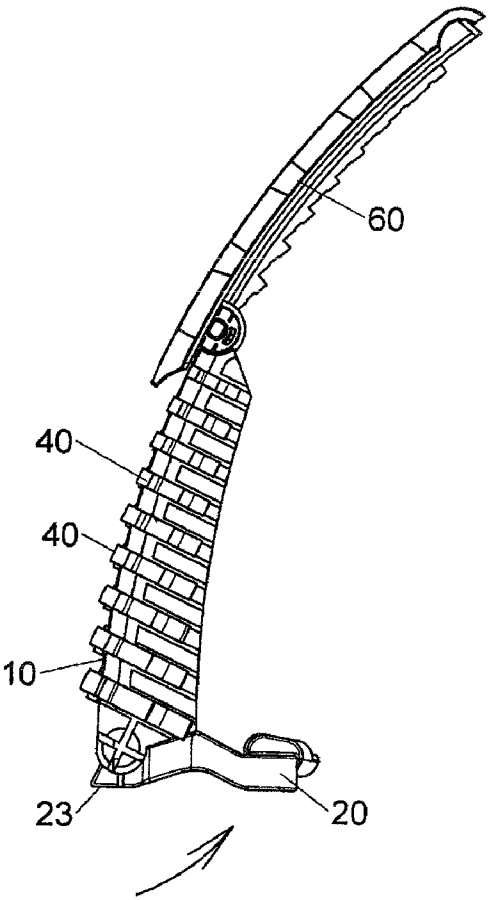
FIG. 10 is a side view of the cover plate pulled up and the hand grip laid to the rear in accordance with the present invention.
Figure 9:
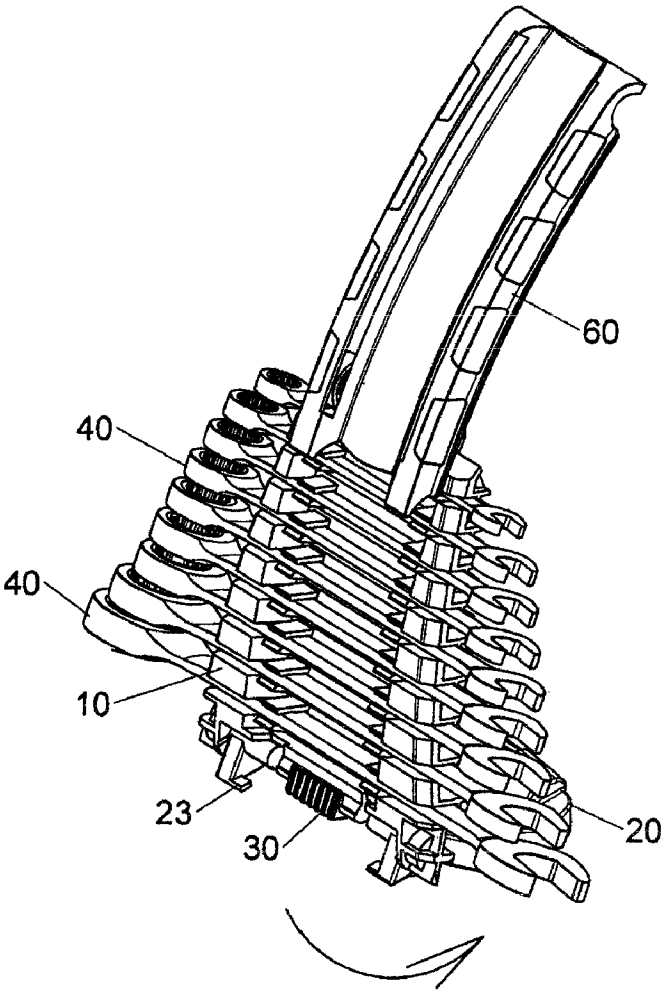
FIG. 9 is a perspective diagram of the cover plate pulled up and the hand grip laid to the rear in accordance with the present invention.
Figure 12:
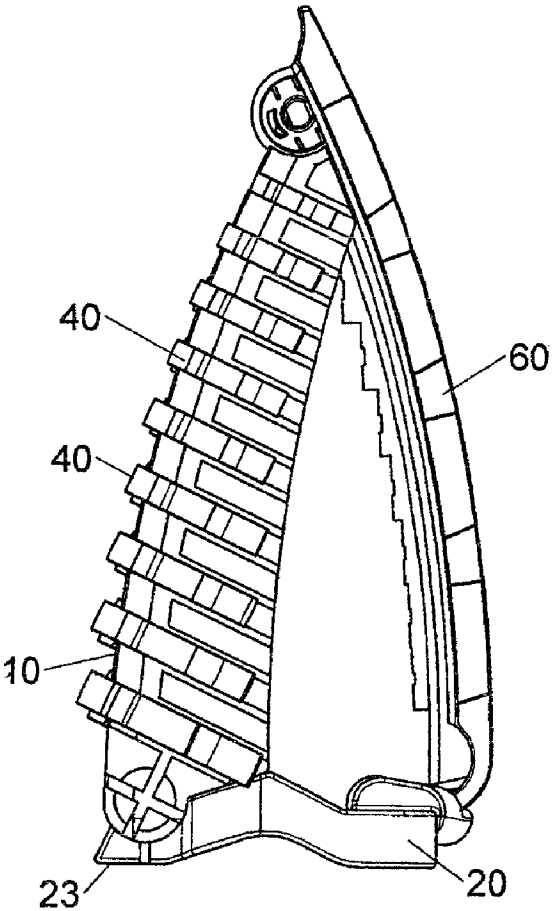
FIG. 12 is a side view of the cover plate and the hand grip laid to the rear in accordance with the present invention.
Figure 11:
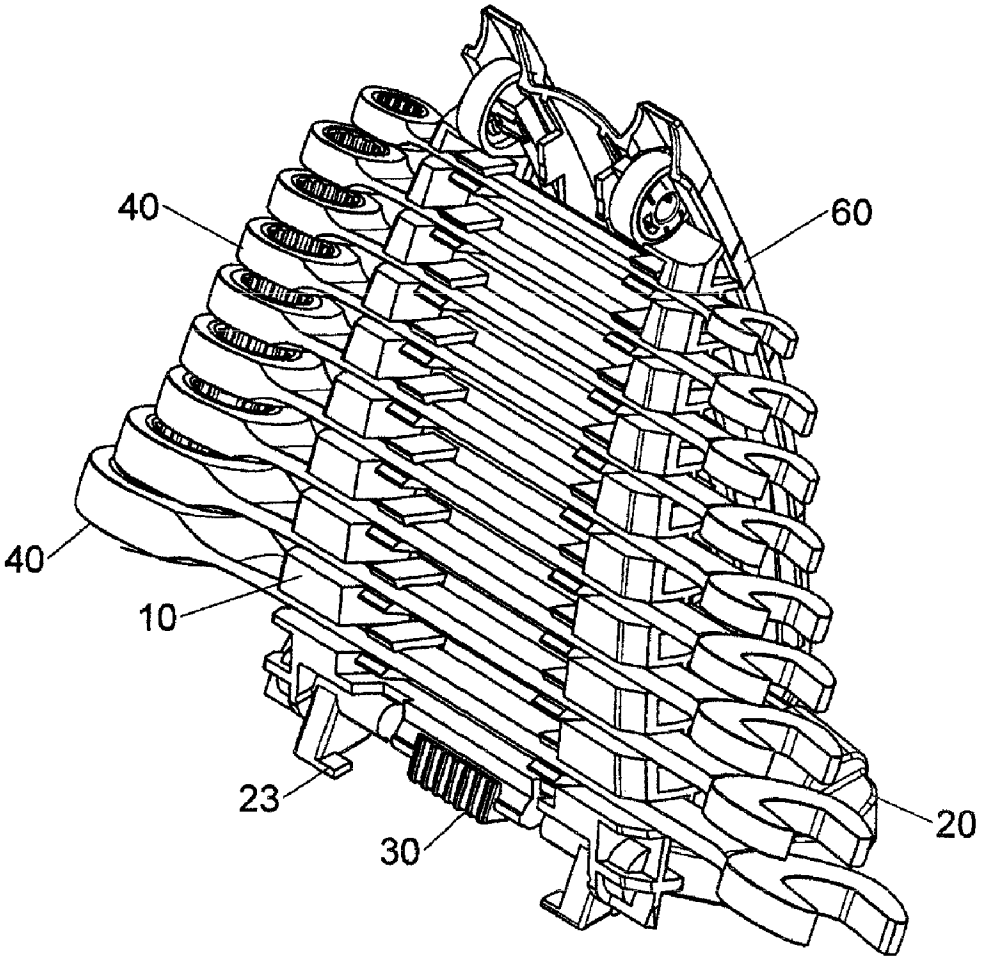
FIG. 11 is a perspective diagram of the cover plate and the hand grip laid to the rear in accordance with the present invention.

Referring to FIGS. 1 and 6, the present invention can be easily assembled. Insert the shaft 21 of the hand grip 20 into the axle hole 13, align the end of the hand grip 20 with the distal end of the strip rail 12, and lodge the protruded portion 22 in the groove 131. The slidable fastener 30 has a sunken housing 31 to slidably hold on to the strip rail 12 and the protruded rod 210. The hand grip 20 allows users to carry the wrench holder conveniently, and it can also be extended against the main frame 10 as a part of the stand. The pivot shaft 51 of the knob 50 is inserted into the pivot hole 14 and the locking wedges 54 are lodged in the furrow 141 or the furrow 142. The first holding strips 61 of the cover plate 60 is engaged between the stop pieces 23 and the shaft 21 of the hand grip 20, and the second holding strips 62 is movably engaged with the locking troughs 52 of the knobs 50.

Referring to FIGS. 7 to 12, users can access wrenches from the holder by sliding up the second holding strips 62 of the cover plate 60 along the locking troughs 52 of the knobs 50, moving the slidable fastener 30 along the middle portion of the strip rail 12 to come off the protruded rod 210, and revolving the hand grip 20 against the main frame 10. Therefore, the hand grip 20 is able to be revolved towards the back of the main frame 10 with an angle greater than 90 degrees, the protruded portion 22 is lodged in another groove 132, and then the hand grip 20 is fixed against the main frame 10 at a certain angle to support the main frame 10 firmly standing on a surface. In the mean time, the cover plate 60 is revolved towards the back of the main frame 10 as well. The moving of the cover plate 60 drives the knob 50, with the pivot shaft 51 as its revolving axis, to revolve against the main frame 10. The locking wedge 54 of the knob 50 is lodged in another furrow 142 for the end of the cover plate 60 to link with the hand grip 20 and to dock on the same surface. Therefore, the main frame 10 is in a firmly standing state, and the recesses 11 are disclosed for users to access the wrenches 40.

Advantages of the present invention are summarized as bellow.

1. After wrenches are placed in the main frame, they can be securely held by covering up the cover plate. The design of such a mechanism makes the holder more convenient for carry or storage.

2. The hand grip and the cover plate are able to revolve against the main frame and to form a stand for the main frame to be firmly erected on a surface. The design of such a mechanism allows users to access wrenches much easier.

While we have shown and described the embodiment in accordance with the present invention, it should be clear to those skilled in the art that further embodiments may be made without departing from the scope of the present invention.

What is claimed is:

1. A portable wrench holder comprising:

a main frame having a plurality of recesses with lateral openings arranged along a front of the main frame, and a strip rail being allocated at the middle portion of a bottom of the main frame with a non-circular cross section; each pair of recesses allowing the handle of a wrench to be engaged and positioned; two axle holes being symmetrically defined at the bottom of the main frame, each end of the strip rail being coaxially correspondent with the axle holes, and two grooves being radially developed at the port of each axle hole; two pivot rings being separately defined on the top of the main frame, each pivot ring having a pivot hole with two furrows radially extended at the outer port of the pivot hole, and an annular prop edge being extended at an inner port of each pivot hole;

a hand grip having two necks, each neck having a shaft extended outwards and a coaxial protruded rod extended inwards, a protruded portion being radially extended from one side of the shaft of at least one neck and a stop piece being arranged at the inner side of at least one neck close to the protruded rod, and the shape of the protruded rod being the same as the cross section of the strip rail; the hand grip and the main frame being integrated as the shafts being inserted into the axle holes, the two protruded rods extended at ends of the hand grip being respectively aligned with two distal ends of the strip rail, and the protruded portion being lodged in one groove to position the hand grip as the hand grip being revolved against the main frame;

a slidable fastener having a sunken housing laterally penetrated at one side, the cross sections of the housing and the strip rail being matched for the housing to hold on to the strip rail and to make the slidable fastener movable along the strip rail; and the hand grip being fixed against the main frame as the slidable fastener being moved to one end of the strip rail with its housing holding on to the shaft;

two knobs having a pivot shaft protruded on one side of each knob with at least one locking tenon and at least one locking wedge, a lateral locking trough being defined through the end of the pivot shaft and a hook being defined at the end of the locking tenon; the knob being lodged in one port of the pivot hole and the hook of the locking tenon being clasped on the prop edge as the pivot shaft being turned and inserted into the pivot hole, and the locking wedge being lodged in the furrow for positioning purpose as the knob being turned against the pivot hole; and a cover plate allowing the front side of the main frame to be covered; a pair of first holding strips, a pair of second holding strips and a pair of protruded plates being extended in parallel on the inner side of the cover plate; the first holding strips and the second holding strips having L-shaped cross sections, two ends of each first holding strips engaging with the stop pieces at the two ends of the hand grip respectively and two ends of each second holding strips movably engaging with the locking troughs of the knobs respectively for the cover plate being able to vertically move against the main frame.

2. The wrench holder as claimed in claim 1, wherein each knob has two locking wedges which are allocated on the knob corresponding to two lateral ends of the locking trough respectively.

3. The wrench holder as claimed in claim 1, wherein each knob has two locking tenons which are symmetrically arranged along the central axis of the knob.

4. The wrench holder as claimed in claim 1, wherein the hand grip is bow-shaped for users to hold on its middle portion and there are two necks jointed at its both ends respectively.

5. The wrench holder as claimed in claim 1, wherein each protruded plate has a plurality of ratchets vertically arranged on its top end for positioning the handles of wrenches.

6. The wrench holder as claimed in claim 1, wherein the strip rail has protruded strips defined on its two sides in order to form a non-circular cross section for the strip rail.

* * * * *